United States Patent [19]

Yamamoto et al.

[11] Patent Number: 4,987,335

[45] Date of Patent: Jan. 22, 1991

[54] SECONDARY ELECTRON MULTIPLIER

[75] Inventors: Hiroshi Yamamoto, Kyoto; Takeshi Terashima, Nagaokakyo, both of Japan

[73] Assignee: Murata Manufacturing Co., Ltd., Japan

[21] Appl. No.: 392,837

[22] Filed: Aug. 11, 1989

[30] Foreign Application Priority Data

Aug. 11, 1988 [JP] Japan ..... 63-202065

[51] Int. Cl.[5] ..... H01J 43/04

[52] U.S. Cl. ..... 313/103 R; 313/103 CM; 250/207

[58] Field of Search ..... 313/103 R, 103 CM; 250/207

[56] References Cited

U.S. PATENT DOCUMENTS 4,652,788 3/1987 Lauche et al. ..... 313/103 R 4,757,229 7/1988 Schmidt et al. ..... 313/103 CM

*Primary Examiner*—Donald J. Yusko

*Assistant Examiner*—Michael Horabik

*Attorney, Agent, or Firm*—Ostrolenk, Faber, Gerb & Soffen

[57] ABSTRACT

A structure for supporting a funnel portion of a secondary electron multiplying tube in a secondary electron multiplier. In the supporting structure for the funnel portion, a support member has a circular contact element for supporting an end face of a mouth of the funnel, and nails formed along the outer periphery of the circular contact element so as to grasp the mouth end portion of the funnel from the outside thereof. A press member is welded to the support member into which the funnel portion is inserted. The posture and position of the funnel portion are correctly determined in relation to an opening of a Farady cup, by fixing the support member to a casing of the secondary electron multiplier.

1 Claim, 5 Drawing Sheets

SECONDARY ELECTRON MULTIPLIER

BACKGROUND OF THE INVENTION

1. Field of the Invention

The present invention relates to a secondary electron multiplier for detecting ions and electrons in a space by detecting secondary electrons drawn out from a secondary electron multiplying tube made of a semiconductive material having a secondary electron emissive property.

2. Description of the Related Art

Recently, so called channel electron multipliers are widely used for detecting ions and electrons in the cosmic space or detecting various ions and atoms in the mass spectrometers.

As shown in FIG. 6, the channel electron multiplier of this type provides a secondary electron multiplying tube 2 made of a semiconductive material having a secondary electron emissive property. The secondary electron multiplying tube 2 provides a funnel portion 2*a* for entering charged particles P such as ions; electrons on the outer surface of which an input electrode 1 is formed. A collector 3 formed by a circular metal plate is arranged so as to opposed an output end 4 of the tube 2 with a gap g of 0.5 to 1.0 mm. In operation thereof, a high negative voltage $E_H$ of (−3) to (−4) kV is applied to the input electrodes 1 and a low negative voltage $E_L$ (−100) to (−200) V is applied to an exit or output electrode 4 formed on the output end of the tube 1 in order to collect a multiplied electron current by the collector 3. This collector voltage $E_L$ is obtained by a voltage drop caused by a resistance R which is connected between the exit electrode 4 and the earth. The current of secondary electrons collected by the collector 3 is charged into a stray capacitance Cs generated between the collector 3 and the earth and, then, the charged electron in the stray capacitance Cs is discharged through a load resistance $R_L$. A voltage generated between both ends of the load resistance $R_L$ at that time is amplified by a first amplifier 5.

FIG. 7 shows a concrete structure of a conventional secondary electron multiplier. Two elongated insulating plates 6 and 7 are fixed in parallel with each other using three studs 8, 9 and 10 and vises 11 and the secondary electron multiplying tube 2 is supported between them. More concretely, it is supported at the neck position of the funnel portion 2*a* and a position near the output end 4 thereof by support metal bands 12 and 13 which are welded on the,studs 8 and 10, respectively. The input electrode 1 and the exit electrode 4 of the tube 2 are electrically conducted to the studs 8 and 10 through the support metal bands 12 and 13, respectively. The collector 3 is welded onto the stud 9 so as to face the output end of the tube 2. A terminal metal plate member 14 is fixed between respective ends of the insulating plates 6 and 7 using vises 11 and nuts 15 and, between other ends of the insulating plates 6 and 7, a face plate 16 having an aperature 16*a* for conducting ions and a Faraday cup Fc is fixed using vises 11 and nuts 15. The Faraday cup Fc is provided for shielding the multiplier from the soft X-ray photons and UV-photons generated in the ion source. A positive voltage $E'_H$ is applied to the face plate 16 as shown in FIG. 6. Also, the Faraday cup Fc repells the ion current coming from the faceplate toward the funnel of the secondary electron multiplier. The terminal metal plate member 14 has first to third hermetical terminals 17, 18 and 19. The first terminal 17 is electrically conducted to the face plate 16 by a lead wire 21 and the second and third terminals 18 and 19 are electrically conducted to studs 8 and 9 by lead wires 22 and 23, respectively. Further, the resistance R is electrically connected between the terminal metal plate member 14 and the stud 10 by lead wires 24*a* and 24*b*.

Meanwhile, in the conventional secondary electron multiplier shown in FIG. 7, the neck portion of the funnel portion 2*a* of the tube 2 is fixed to the stud 8 by the metal band 12 which is welded thereto. Namely, the metal band 12 is wound around the neck portion of the funnel portion 2*a* and is fastened thereto using a vis 24 and a nut 25 and, thereafter, the position of the funnel portion 2*a* of the tube 2 toward the Faraday cup Fc are determined according to a predetermined standard so as to face the Faraday cup Fc. Then, the free end of the metal band 12 is fixed to the stud 8 by the spot welding.

However, in the structure of the conventional secondary electron multiplier mentioned above, it is difficult to weld the metal band 12 to the stud 8 maintaining the position thereof determined according to the predetermined standard and, therefore, it requires much skill.

Further, in the conventional secondary electron multiplier mentioned above, the negative high voltage $E_H$ is applied to the input electrode 1 through the second terminal, the lead wire 22, the stud 8 and the metal band 12. Since it is necessary to apply the negative high voltage $E_H$ to the end surface of the mouth of the funnel portion 2*a*, it becomes necessary to form an insulating membrane (not shown) on the outer surface of the funnel portion 2*a* in which the input electrode 1 is formed. Due to this, the cost of the product comes high.

SUMMARY OF THE INVENTION

One of objects of the present invention is to provide secondary electron multipliers in which position of a funnel position of a secondary electron multiplying tube can be easily set.

Another object of the present invention is to provide secondary electron multipliers which can be easily assembled.

One more object of the present invention is to provide secondary electron multipliers cost of which can be reduced.

In order to achieve these objects, according to the present invention, there is provided a secondary electron multiplier comprising a pair of insulating plates arranged in parallel with each other which are fixed by a face plate having an incident aperture of charged particles and a terminal plate member, a secondary electron multiplying tube having a funnel portion at the input end thereof which is made of a semiconductive material having a secondary electron emissive property and a collector for collecting a flow of secondary electrons multiplied by said multiplying tube wherein said secondary electrons multiplied tube is supported between said pair of insulating plates in such a manner that the mouth of said funnel is inclined at a predetermined angle to an opening of a Faraday cup fixed rear side of said incident aperture of said face plate, said secondary electron multiplier being characterized by further comprising a support metal member which provides a circular contact element for supporting an end face of said mouth of said funnel, plural nails formed along the outer periphery of said circular contact element for grasping said mouth of the funnel from outside thereof and a pair of support arms being extended from the outer periphery of said contact element toward said respective insulating plates, said support arms having portions bent along said insulating plates so as to fix them to said insulating plates, and a press metal member to be fitted to the outer periphery of said funnel near the mouth thereof which is welded to said support metal member to support the funnel fixedly to said support metal member.

BRIEF DESCRIPTION OF THE DRAWINGS

These and other objects and features of the present invention will become clear from the following description taken in conjunction with the preferred embodiments thereof with reference to the accompanying drawings, in which:

FIG. 3 (*b*) is a cross-sectional view along II—II line of FIG. 3 (*a*);

DETAILED DESCRIPTION OF THE PREFERRED EMBODIMENT

Figure 1:
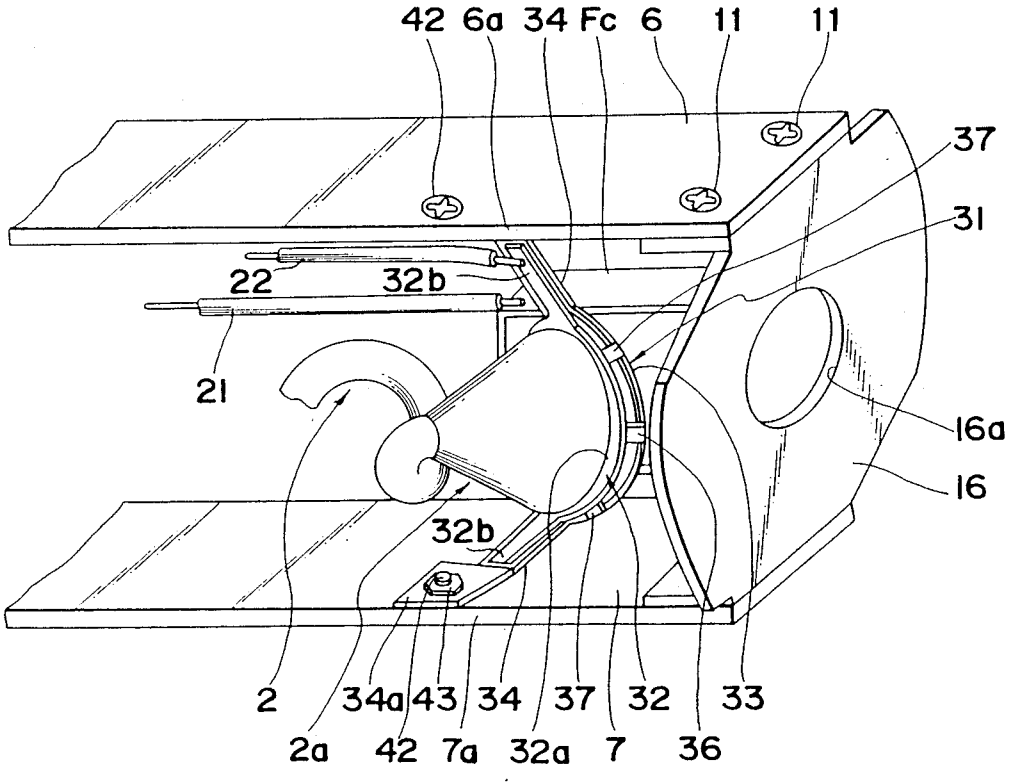
FIG. 1 is a partial perspective view showing a main portion of a secondary electron multiplier according to the preferred embodiment of the present invention.
Figure 2:
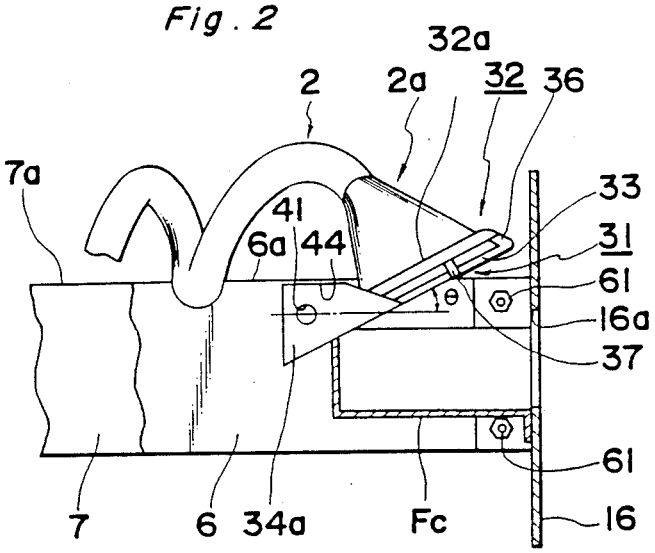
FIG. 2 is a vertical cross-sectional view of the main portion of the secondary electron multiplier shown in FIG. 1.

FIG. 1 shows a main portion of the secondary electron multiplier according to the preferred embodiment of the present invention and FIG. 2 shows a cross-sectional view of the main portion shown in FIG. 1.

Figure 6:
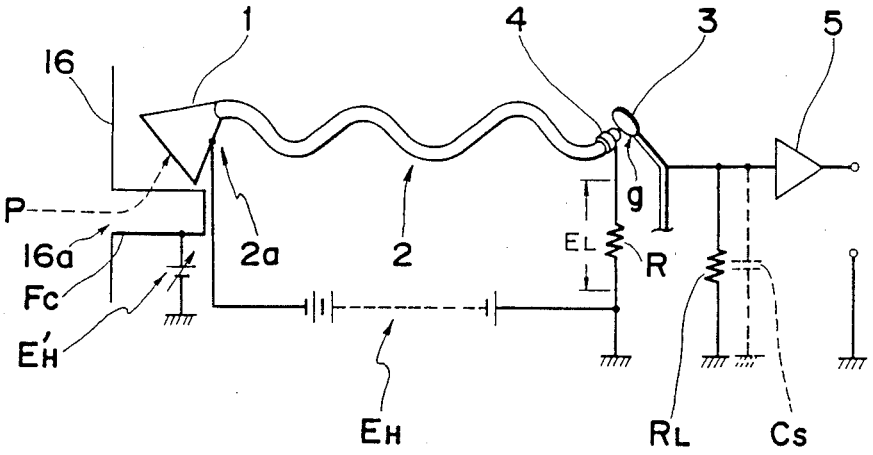
FIG. 6 is an electric circuit of the secondary electron multiplier.
Figure 7:
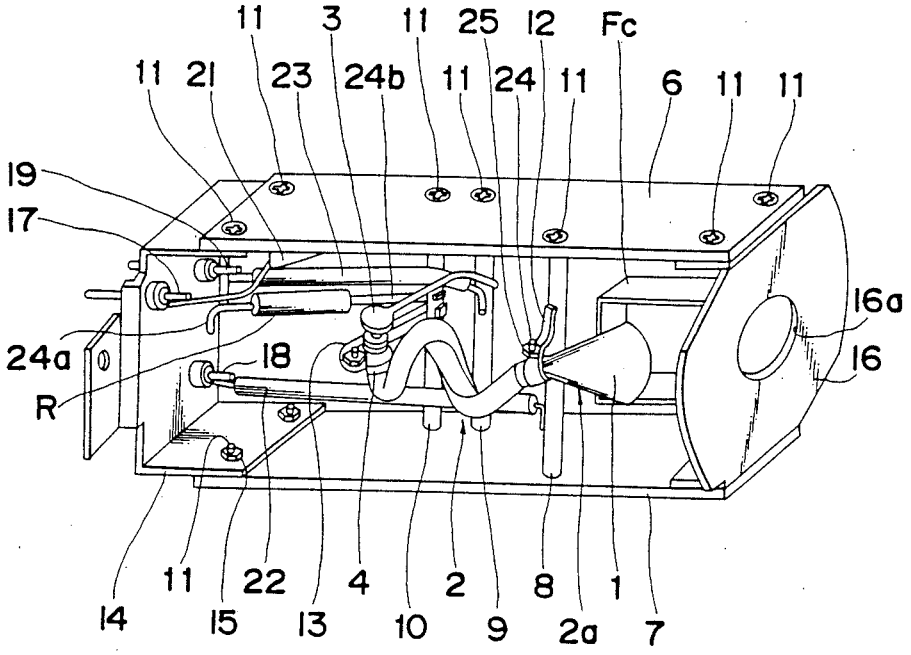
Fig. 7 PRIOR ART
FIG. 7 is a perspective view of a conventional secondary electron multiplier.

According to the present invention, the support structure for the funnel portion 2*a* of the secondary electron multiplying tube 2 is improved and elements or members other than elements needed for the support structure are substantially same to those of the conventional secondary electron multiplier as shown in FIG. 7 and the electric circuit shown in FIG. 6 is applied to the present multiplier as it is. Therefore, like reference numerals in FIGS. 1 and 2 indicate like elements or members of the conventional multiplier shown in FIG. 7.

As shown in FIG. 1, the mouth portion of the funnel 2*a* of the secondary electron multiplying tube 2 is fixed between the insulating plates 6 and 7 using a support member 31 and a press member 32 which are formed by stamping a metal sheet such as a stainless steel sheet.

Figure 3A:
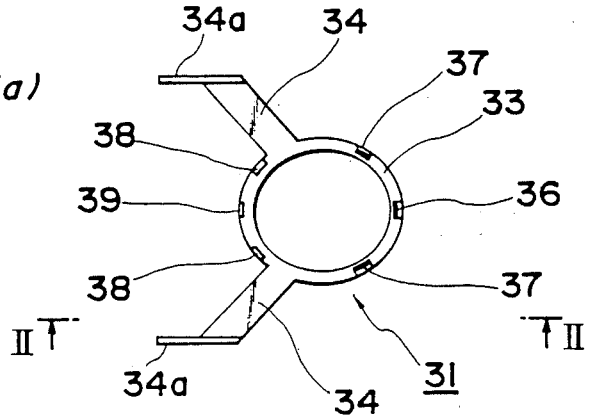
FIG. 3 (*a*) is a plane view of a support element for supporting a mouth portion of a funnel portion of a secondary electron multiplying tube.
Figure 3B:
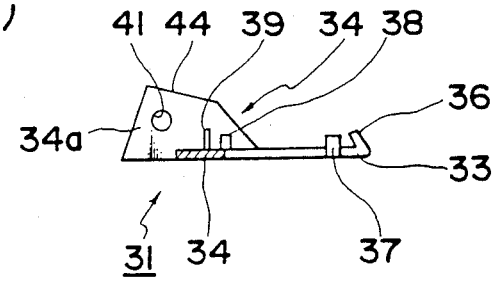
Figure 4D:
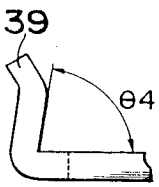
FIG. 4 (*a*), 4 (*b*), 4 (*c*) and 4 (*d*) are explanatory views for showing bending angles of nails formed along a periphery of a support ring of the support element shown in FIG. 3, respectively.
Figure 4C:
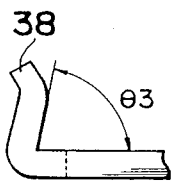
Figure 4B:
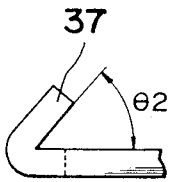
Figure 4A:
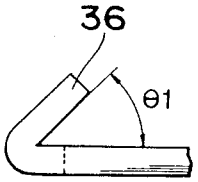
Figure 5:
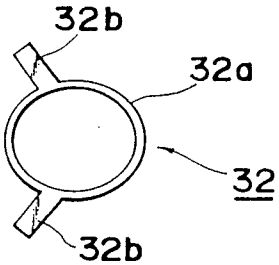
FIG. 5 is a plane view of a press element to be assembled together with the support element shown in FIG. 3 (*a*)

As shown in FIGS. 3 (*a*) and 3 (*b*), the support member 31 has a support ring 33 which contacts to the end surface of the mouth portion of the funnel 2*a* and a pair of support arms 34 and 34 which are extended from the support ring 33 obliquely in upward and downward directions, respectively.

The support ring 33 has six nails 36, 37, 37, 38, 38 and 39 which are formed along the outer periphery thereof symmetrically with respect to a center line passing the center nails 36 and 39. These six nails are bent upwardly at respective angles $\theta_1$, $\theta_2$, $\theta_3$, and $\theta_4$ of elevation as shown in FIGS. 4 (*a*) to 4 (*d*). These angles of elevation are predetermined so as to fit the mouth portion of the funnel 2*a* in such a manner that individual nails can hold the outer peripheral surface of the funnel 2*a* from the outside thereof when the end surface of the mouth of the funnel 2*a* is contacted to the support ring 33.

On the other hand, the support arms 34 and 34 are formed symmetrically with respect to the center line passing the nails 36 and 39 and respective free ends of them are bent by a right angle so as to contact to the inner surfaces of the insulating plates 6 and 7 (See FIGS. 1 and 2). Each of bent portions 34*a* and 34*a* has a vis hole 41 for fastening the same to the insulating plate 6 or 7 using a vis as shown in FIG. 1.

In the meanwhile, the press member 32 is comprised of a press ring 32*a* into which the funnel 2*a* of the tube is fitted and a pair of arms 32*b* and 32*b* extending in parallel with the support arms 34 and 34 of the support member 31.

As shown in FIGS. 1 and 2, the press ring 32*a* is fitted to the funnel 2*a* of the tube 2 near the mouth thereof and, thereafter, it is spot welded to six nails 36~39 of the support ring 33 of the support member 31. Further, the arms 32*b* and 32*b* are spot welded to the support arms 34 and 34, respectively. Thus, the funnel 2*a* of the secondary electron multiplying tube 2 is supported fixedly by the support member 31 at the mouth portion thereof.

The support arms 34, 34 of the support member 31 are fixed by fastening them to the insulating plates 6, 7 using vises 42 inserted from the vis holes 41 of the bent portions 34*a* of the support element 34 and nuts 43.

According to the fixing structure of the funnel 2*a* of the tube 2, it is always positioned correctly to the Faraday cup Fc. In other words, an angle $\theta$ defined between the end plane of the mouth of the funnel 2*a* and the opening plane of the Faraday cup Fc is determined uniquely by fixing the support member 31 between the insulating plates 6 and 7. Thus, the secondary electron multiplying tube 2 can be mounted very easily since an adjustment operation for positioning the funnel 2*a* to the Faraday cup Fc becomes unnecessary.

Further, it becomes unnecessary to form an input electrode on the outside of the funnel 2*a* as in the conventional case, since it becomes possible to apply the negative high voltage $E_H$ directly to the mouth portion of the funnel 2*a* through the support member 31. Also, the stud 8 for supporting the funnel 2*a* can be omitted by using the support member 31 and the press member 32.

It is understood that various other modifications will be apparent to and can be readily made by those skilled in the art without departing from the scope and spirit of the present invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which the present invention pertains.

What is claimed is:

1. A secondary electron multiplier comprising a pair of insulating plates arranged in parallel with each other which are fixed by a face plate having an incident aperture for charged particles and a terminal plate member, a secondary electron multiplying tube having a funnel portion at the input end thereof which is made of a semiconductive material having a secondary electron emissive property and a collector for collecting a flow of secondary electrons multiplied by said multiplying tube wherein said secondary electron multiplying tube is supported between said pair of insulating plates in such a manner that the mouth of said funnel is inclined at a predetermined angle to an opening of a Faraday cup fixed at the rear side of said incident aperture of said face plate, said secondary electron multiplier being characterized by further comprising a support metal member having a circular contact element for supporting an end face of said mouth of said funnel, plural nails formed along the outer periphery of said circular contact element for grasping said mouth of the funnel from outside thereof and a pair of support arms being extended from the outer periphery of said circular contact element toward said respective insulating plates, said support arms having portions bent along said insulating plates so as to fix them to said insulating plates, and a press metal member to be fitted to the outer periphery of said funnel near the mouth thereof which is welded to said support metal member to support the funnel fixedly to said support metal member.

* * * * *